United States Patent [19]

Greer

[11] 4,059,155

[45] Nov. 22, 1977

[54] JUNK BASKET AND METHOD OF REMOVING FOREIGN MATERIAL FROM A WELL

[75] Inventor: Tom R. Greer, Houston, Tex.

[73] Assignee: International Enterprises, Inc., Houston, Tex.

[21] Appl. No.: 706,387

[22] Filed: July 19, 1976

[51] Int. Cl.[2] ..... E21B 31/06; E21B 31/08

[52] U.S. Cl. ..... 166/301; 166/65 M; 166/99; 175/237; 294/65.5; 175/254

[58] Field of Search ..... 166/99, 301, 98, 100, 166/65 M, 192, 193, 107, 156; 175/237; 294/65.5

[56] References Cited

U.S. PATENT DOCUMENTS

| | | | |
|---|---|---|---|
| 2,550,228 | 4/1951 | Costin | 166/99 |
| 2,613,980 | 10/1952 | Hawkins | 166/65 M |
| 2,617,486 | 11/1952 | Davis | 166/99 |
| 2,638,988 | 5/1953 | Williams | 166/99 |
| 2,657,752 | 11/1953 | Ballew et al. | 166/65 M |
| 2,675,879 | 4/1954 | Middleton et al. | 166/99 |
| 2,789,790 | 4/1957 | Kirby | 166/99 X |
| 3,814,180 | 6/1974 | Oliver | 166/99 |

OTHER PUBLICATIONS

*Composite Catalog of Oil Field Equipment & Services,* vol. 2, 1962–1963, 25th Rev., World Oil, Houston, Texas, p. 2836.

*Composite Catalog of Oil Field Equipment & Services,* vol. 3, 1962–1963, 25th Rev., World Oil, Houston, Texas, p. 4992.

*Primary Examiner*—Stephen J. Novosad

*Attorney, Agent, or Firm*—Browning, Bushman & Zamecki

[57] ABSTRACT

An improved junk basket comprises a tool body having a longitudinally extending passageway therethrough and a magnet assembly disposed in the passageway. A retainer is cooperative between the magnet assembly and the tool body to retain the magnet assembly in a lower position in the passageway and selectively releasable to permit longitudinal movement of the magnet assembly to an upper position in the passageway whereby core cutting apparatus and/or an improved reverse circulation system, also included in the tool, may be employed.

27 Claims, 6 Drawing Figures

JUNK BASKET AND METHOD OF REMOVING FOREIGN MATERIAL FROM A WELL

BACKGROUND OF THE INVENTION

1. Field of the Invention

The present invention pertains to the drilling and/or production of wells such as are used to recover petroleum and natural gas. During the course of such operations, various foreign bodies, such as tools or parts of tools, teeth which have become dislodged from drill bits, etc. may fall to the bottom of the well or may become lodged in the well some distance from the bottom. Such bodies, referred to as "junk", are frequently formed of hard metals or like material which can not readily be drilled through without damage to the drill bit. They must therefore be removed by other techniques before work on the well can continue. The tools used for removing such junk are commonly known as fishing tools or "junk baskets" and generally include means for engaging or collecting the junk so that, when the junk basket is withdrawn from the well, the junk is also removed.

2. Description of the Prior Art

There are three basic types of conventional junk baskets. One of these is the magnetic type which is typically used to fish the bottom of the well for junk comprised of ferrous metal. An example of this type of tool is shown in prior U.S. Pat. No. 2,834,630 to Greer. In this tool the magnet is floatingly mounted in a housing for rotational and limited longitudinal movement.

Another conventional type of junk basket is the circulation type in which drilling fluid is circulated through and around the tool to dislodge and pick up the junk and sweep it into the basket where it is retained. Some such tools operate by direct circulation while others operate by reverse circulation, and in either case, they are typically used for collecting relatively small or easily dislodged pieces of junk, whether ferrous or not.

Still another type of junk basket is the core cutting type, examples of which are shown in U.S. Pat. No. 2,471,616 and on page 2019 of the *Composite Catalog of Oilfield Equipment and Services,* 1964–65. Such tools include a cylindrical body open at the bottom and having teeth mounted around the lower end. Where the junk is large, tightly lodged in the well, and/or densely packed, this type of tool may be used to mill the junk or to cut a core through the junk. The core is received within the cylindrical body as the tool is urged downwardly and catchers are provided within the body to retain the core.

Each of these basic types of junk baskets is somewhat limited in its applications. Thus, where only such conventional tools are used, it is necessary to keep several types at the well site so that the proper one can be used as circumstances dictate. However, this is unduly expensive. Furthermore, it is often the case that one type of tool will be run into the well but will fail to satisfactorily remove the junk, so that it must be followed by a run of another type of tool. This makes the junk removal process quite time consuming and further increases the expense.

Several attempts have been made to provide a junk basket capable of removing junk by more than one technique. However, none of these have been entirely satisfactory. The 1964–65 *Composite Catalog of Oilfield Equipment and Services,* p. 2019 shows a magnetic type tool having milling teeth adjacent the magnet. However, these teeth could only be used to help dislodge and break up the junk which is to be picked up by the magnet and not to cut a core.

Prior U.S. Pat. No. 3,023,810 shows a junk retriever having a core cutting type of mechanism at its lower end as well as means for converting the tool from direct to reverse circulation. However, the circulation passages are formed in the tool by a number of different parts arranged in a rather complicated manner and in such a way that they might be relatively easily clogged.

Prior U.S. Pat. No. 2,710,741 to Hall also shows a fishing tool having core cutting and reverse circulation means. As in the tool of U.S. Pat. No. 3,023,810, the circulation passage system is relatively complicated and involves a number of different parts. Furthermore, the orientation of the passages is such as to create high turbulence in use and does not adequately direct the fluid in the desired paths. Finally, the tool must be adjusted for either direct or reverse circulation before it is run into the well and can not be altered downhole.

Still another combination type of junk basket is disclosed in the 1964–65 *Composite Catalog of Oilfield Equipment and Services,* pp. 736 and 738. The tool includes milling teeth and reverse circulation means which, once again, are unduly complicated and involve numerous parts. A magnet may be secured in the tool to convert it to a magnetic type of fishing tool. However, the magnet is not capable of augmenting or being used with the core cutting or reverse circulation techniques, but rather replaces them.

SUMMARY OF THE INVENTION

The present invention provides a junk basket in which a magnet assembly is disposed in a longitudinal passageway through the tool body and which preferably also includes core cutting and/or reverse circulation means. Retainer means retain the magnet assembly in a lower position in the passageway, as during running in of the tool, and are selectively releasable to permit longitudinal movement of the magnet assembly to an upper position in the passageway. Thus, with the magnet assembly in the lower position, the tool may be used for magnetic fishing. Subsequently or alternatively, a core cutting or reverse circulation technique may be employed and the magnet will be urged into its upper position by the core moving into the tool body or will be pumped to its upper position by the circulating fluid. This allows relatively large quantities of junk to move into the tool body beneath the magnet assembly. A magnet catcher assembly is preferably provided in the upper portion of the tool body to retain the magnet against downward movement from its upper position.

Thus the tool of the present invention not only allows two or three different junk collecting techniques to be used alternatively or sequentially in a single run of the tool, but also allows the various techniques to augment one another. For example, the magnet assembly and magnet catcher help to retain junk which is drawn into the basket by the core cutting or reverse circulation means.

In the preferred embodiments, the tool body has a number of flowways therein communicating with the longitudinal passageway. The longitudinal passageway and the flowways are so constructed and arranged as to enable the tool to be easily converted from direct to reverse circulation, and vice versa, downhole any number of times. The improved circulation system also helps to direct the fluid in the proper paths and minimize undesirable turbulence. Yet the entire system of flowways and the longitudinal passageway may be provided in a single integral tool body part thereby simplifying the tool and minimizing expense. Indeed the improved circulation system has application not only to junk baskets but to many other types of tools in which it is necessary to alternate between direct and reverse circulation downhole.

Accordingly, it is a principal object of the present invention to provide an improved junk basket.

It is another object of the present invention to provide a selectively movable magnet assembly in a junk basket which may be used along with core cutting and/or reverse circulation means.

Still another object of the invention is to provide a versatile junk basket in which the technique of junk collection to be used need not be predetermined prior to running the tool into the well.

A further object of the present invention is to provide an improved variable direct and reverse circulation tool.

Yet another object of the present invention is to provide an improved method of removing foreign material from a well.

Still other objects, features, and advantages of the present invention will be made apparent by the following description of the preferred embodiment, the drawings and the claims.

DETAILED DESCRIPTION OF THE DRAWINGS

Figure 1:
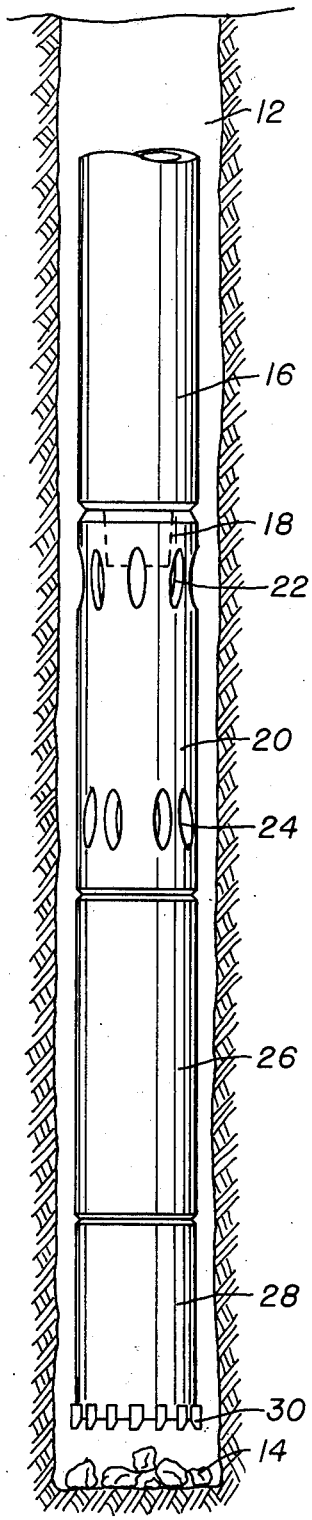
FIG. 1 is a side elevational view of the apparatus of the present invention positioned near the bottom of a well bore.

Referring now to the drawings in detail, FIG. 1 is a side elevational view of the apparatus of the present invention positioned near the bottom of a well bore. Well bore 12 may be cased, although an uncased well bore is shown, having junk or deleteious material 14 at the bottom of the well bore.

A drill pipe collar 16 is threadedly coupled through threads 18 to the apparatus of the present invention. Such apparatus comprises a tool body including an upper sub 20, a middle sub 26 and a lower sub 28 threadedly connected as shown. It should be noted that terms such as "upper," "lower," etc. will be used herein with reference to the apparatus as it is shown in the drawing, it being understood that in actual use the orientation of the apparatus will vary. Each of the subs 20, 26 and 28 is generally tubular whereby a passageway 21 extending longitudinally through the tool body is defined. The lower portion of passageway 21 is of relatively large diameter and serves as a junk collection chamber as will be described more fully below.

A magnet assembly generally indicated by the numeral 69 is disposed in the large diameter portion of passageway 21. Initially, magnet assembly 69 is located in the lower position shown in FIG. 2, i.e. just above the lower end of sub 28. Lower sub 28 has its inner surface recessed to receive a pair of annular, longitudinally abutting junk catcher assemblies 23 and 25. This recess includes an annular, upwardly directed shoulder 27 on which the lower junk catcher assembly 25 is supported. Upper junk catcher assembly 23 is supported on assembly 25. The lower end of middle sub 26 is received in lower sub 28 and abuts the upper end of assembly 23. Thus the assemblies are longitudinally fixed but relatively rotatable with respect to the tool body. A plurality of shear pins 68 extend through lower junk catcher assembly 25 and into the magnet assembly 69. Thus the junk catcher assemblies 23 and 25, together with the shear pins 68 serve as retainer means to retain the magnet assembly 69 against longitudinal movement in the passageway 21.

Lower sub 28 has a plurality of teeth or mills 30 mounted about its lower end. Teeth 30 may be utilized upon rotation of the apparatus of the present invention to break up into smaller fragments the junk or deleteious material 14 so that it may be picked up by the magnetic or reverse circulation means of the present invention and/or to collect the junk by core cutting.

The portion of the longitudinal passageway 21 in the upper sub 21 includes a section 32 of relatively small diameter communicating with the threaded opening at 18. A plurality of flowways 34 have their radially inner ends communicating with section 32 of passageway 21 and extend downwardly therefrom through sub 20 to their radially outer ends 24. Flowways 34 are spaced circumferentially about sub 20. Below section 32 passageway 21 has a smaller diameter section 33 and below this an even smaller diameter section 35. The upwardly directed shoulder 36 formed between sections 33 and 35 serves as a valve seat in a manner to be described more fully below.

Figure 5:
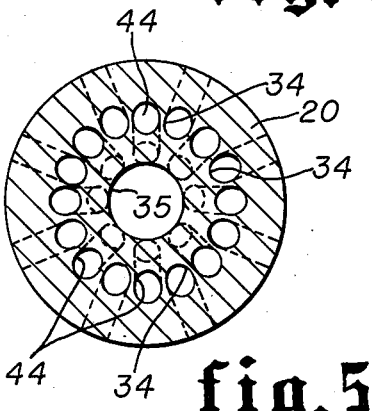
FIG. 5 is a sectional, plan view taken along line 5—5 of FIG. 2.
Figure 6:
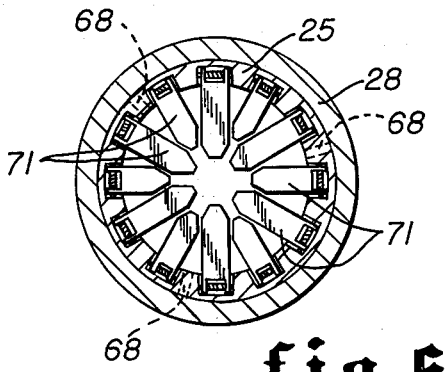
FIG. 6 is a section plan view taken along line 6—6 of FIG. 3.

Beneath section 35, passageway 21 has a relatively large diameter section 38, a downwardly directed shoulder 39 being formed between sections 35 and 38. A plurality of flowways 44 have their radially inner ends communicating with section 38 through shoulder 39 and extend upwardly therefrom to their radially outer ends 22. Flowways 44 are spaced circumferentially about sub 20 alternately with flowways 34 (see FIG. 5). Beneath section 38, passageway 21 widens to an even larger diameter section 40 which extends through the lower portion of sub 20 as well as through subs 26 and 28.

Sub 26 has an internal annular recess 49 near its upper end in which is received a magnet catcher assembly 51. Assembly 51 rests on the upwardly directed annular shoulder defined by recess 49, and the lower end of sub 20, which is received in the upper end of sub 26 as shown, forms an opposed stop to limit upward movement of the magnet catcher assembly 51. Assembly 51 includes a plurality of fingers or magnet catcher elements 52 which are spring tensioned inwardly through ports 54 in assembly 51 and into section 40, and such magnet catcher elements hold the magnet assembly 69 in an upper position in a manner to be described subsequently.

Figure 4:
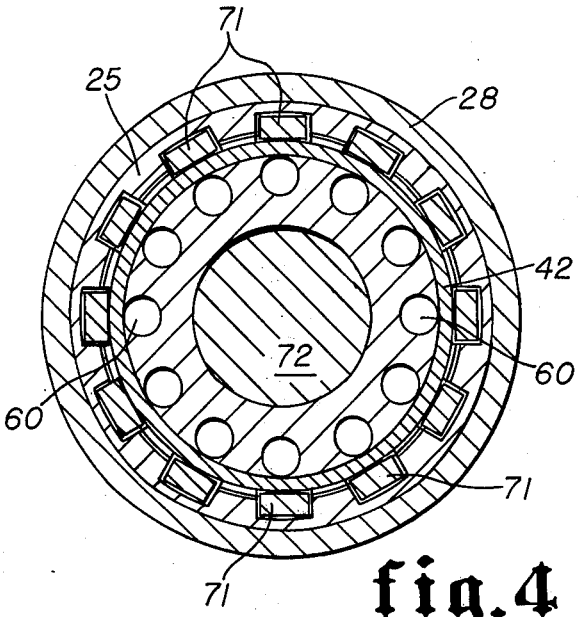
FIG. 4 is a sectional, plan view of the apparatus of the present invention on an enlarged scale taken along line 4—4 of FIG. 2.

Magnet assembly 69 comprises a generally cylindrical housing 42 having external annular ribs defining downwardly directed shoulders 73 and 75. A body 70 of magnetic insulation is disposed within housing 42 and secured therein by a suitable cement or adhesive. Insulating body 70 has a plurality of circumferentially spaced circulation parts 60 extending longitudinally therethrough (compare FIGS. 2 and 4). The magnetic body 72 is enclosed in insulating body 70.

Figure 2:
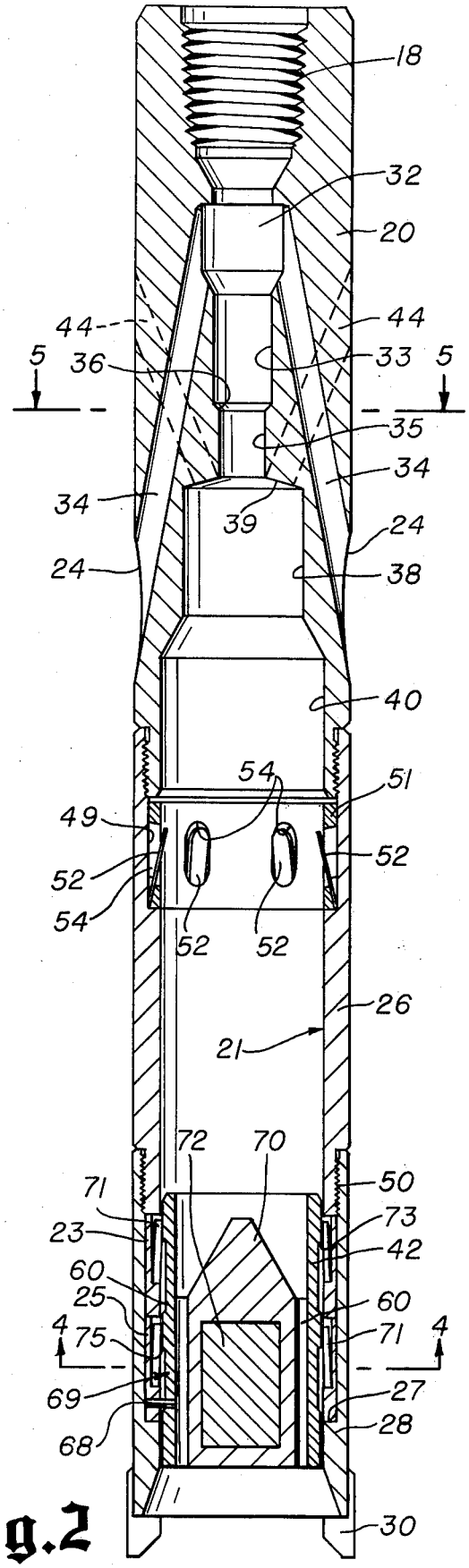
FIG. 2 is a sectional side elevational view of the apparatus of the present invention showing the magnetic element positioned in the lower portion of such apparatus.

Each of the junk catcher assemblies 23 and 25 comprises an annular frame and a plurality of fingers or junk catcher elements 71 each having one end hingedly mounted on the frame in a well known manner. The fingers 71 are spring biased downwardly and inwardly into their lowermost positions, shown in FIG. 3, but can be deflected upwardly and outwardly into recesses in the frame. As shown in FIG. 2, magnet assembly 69 holds the catcher elements in these recesses when it is in the lower position.

When the apparatus of the present invention as shown in FIG. 2 is run into a well bore, the shear pins 68, in cooperation with the junk catcher assemblies 23 and 25, the shoulder 27, and the lower end of sub 26 retain the magnet assembly 69 in the lower position shown in FIG. 2. When the bottom of the well, or other location of junk such as 14, is reached, the magnet assembly 69 may be used to fish for ferrous junk, preferably by rotation of the tool and direct circulation of fluid therethrough. During such circulation, the drilling fluid passes downwardly primarily through passageway 21 and through ports 60, although a small portion may flow through flowways 34. The agitation thus caused near the bottom of the lower sub 28 helps the ferrous material to be drawn to the bottom of the magnet assembly 69. The drilling fluid then passes up the well bore on the outside of the apparatus of the present invention in a manner well known in the drilling art. The rotation of the tool also helps loosen the junk, and in at least some instances, allows the teeth 30 to mill the junk into smaller fragments.

If the magnet assembly 69 should become jammed against the junk, the tool body 20, 26, 28 will still be permitted to rotate about the junk catcher assemblies 23, 25 and the magnet assembly 69 since the shear pins 68 do not extend into the sub 28. Thus damage to the tool is prevented. If a significant downward force is being exerted on the tool, the shear pins 68 may be broken. However, the magnet assembly 69 can still be retained in its lower position by the direct circulation of fluid to permit completion of the magnetic fishing operation.

Figure 3:
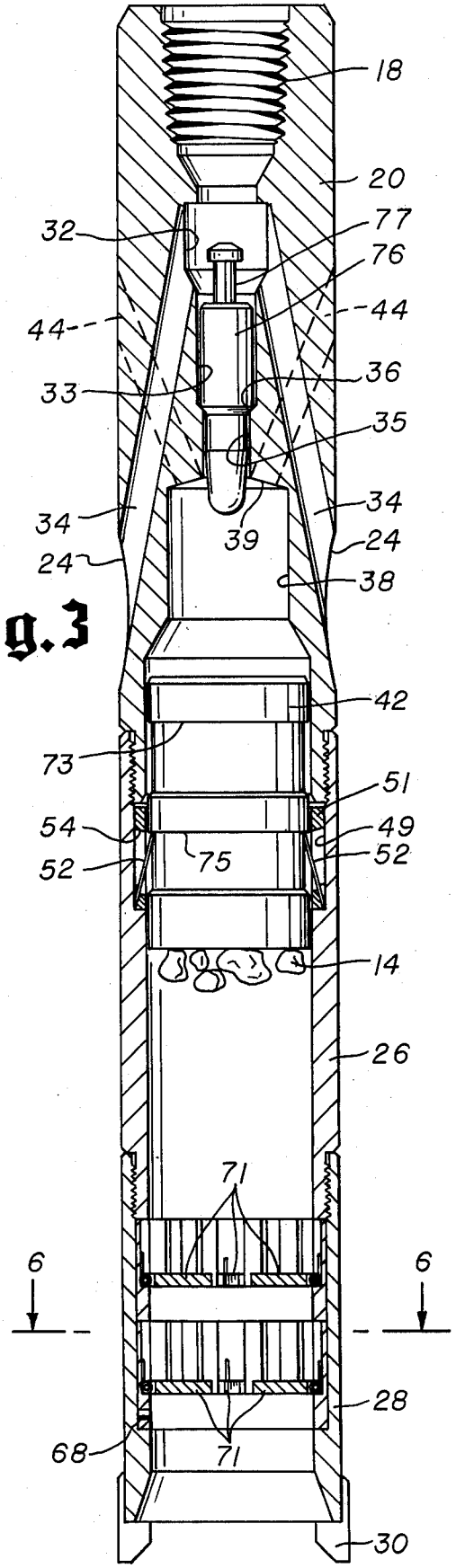
FIG. 3 is a sectional view of the apparatus of the present invention showing the magnetic element positioned in the upper portion of the tool.

After magnetic fishing has been completed, or if no such fishing is desired, the pins 68 may be sheared by rotating the tool and exerting a downward force thereon so that the magnet assembly 69 is now free to move into an upper position in which the fingers 52 engage shoulder 73 to prevent downward movement of the magnet assembly from its upper position. Further upward movement of the magnet assembly 69 is still permitted to an even higher position as shown in FIG. 3 in which fingers 52 engage shoulder 75 of the magnet assembly to prevent downward movement thereof. The upward movement of the magnet assembly 69 can be accomplished by reverse circulation and/or by by coring.

To vary the tool for reverse circulation a valve element in the form of a plug 76 is dropped into the drill string at the surface of the well bore and pumped down until it seats on shoulder 36 as shown in FIG. 3. When plug 76 has seated, the drilling fluid cannot flow downwardly through passageway 21 past the plug but instead flows through flowways 34 and downwardly along the outside of the tool below ports 24. The fluid then passes upwardly into the lower portion of passageway 21 and through ports 60 in the magnet assembly. When the fluid reaches section 38 of passageway 21, it will not unseat the plug 76 and continue through passageway 21 but rather will flow upwardly through flowways 44 due to the relatively large difference in the diameters of the passageway 21 on opposite sides of the valve element 76. After passing through flowways 44, the fluid flows upwardly to the top of the well in the annulus between the well wall and the drill string in the usual manner.

During such reverse circulation, fluid pressure acts against the magnet assembly 69 to cause it to be pumped up into the magnet catcher assembly 51 while simultaneously carrying junk into the lower portion of passageway 21 which serves as a collection chamber. As magnet assembly 69 moves upwardly past the junk catcher assemblies 23 and 25, their fingers 71 tend to spring downwardly and inwardly to the positions shown in FIG. 3. The force of the fluid flowing upwardly through passageway 21 is sufficient to deflect the fingers 71 and allow the junk to pass upwardly into the area between the magnet assembly 69 and the junk catcher assemblies 23 and 25. However since the fingers 71 can not be deflected downwardly from the position of FIG. 3, they prevent the junk from falling out of the basket once it has been taken in. Since at least part of this junk is usually of ferrous metal, the magnetic force of assembly 69 will also attract further circulating junk and help retain the junk in the basket. When it is desired to return the tool to a direct circulation mode of operation, a reduced diameter portion 77 of plug 76 may be engaged by an overshot to remove the plug from the tool.

Subsequently to, or alternatively to, the reverse circulation process, a coring process may be performed which permits a core to be cut through any remaining junk to collect the same and/or allows a core sample to be taken of the bottom of the well. This is accomplished by rotating the tool and exerted a downward force thereon. The teeth 30 are thus caused to dig into the junk and/or the formation to cut the core which moves into the lower portion of passageway 21 as the tool moves downwardly. Once again the fingers 71 may be deflected upwardly to allow the core to pass them, but will jam against the core if it tends to move downwardly. If magnet assembly 69 has not already been moved to its upper position by reverse circulation, it will be so moved by the core entering the basket.

It can be seen that one of the most valuable features of the tool of the invention is its versatility, and that many modifications of the techniques described above are possible with this tool. For example, the tool may be altered from direct to reverse circulation mode and vice versa downhole as many times as desired. If it is known that no magnetic fishing will be necessary or if it is desired to increase the junk carrying capacity of the tool, the magnet assembly 69 may be removed from the tool before it is run into the hole by removing sub 28 from sub 36 and lifting the junk catcher assemblies and magnet assembly upwardly. The junk catcher assemblies and sub 26 are then replaced.

It can be seen that the present invention provides apparatus for performing a plurality of complimentary functions in the bottom of a well bore without the necessity of pulling the drill string, changing the tool, and running the drill string back into the hole again. The apparatus of the present invention is relatively simple, efficient, and satisfies a long-felt need for providing the results which can be achieved with such apparatus. Additionally, the tool provides a simple but effective variable direct and reverse circulation system in which all flowways may be formed in one integral sub.

Numerous modifications in the tool itself as well as the method of use may be made without departing from the spirit of the invention. For example, upper sub 20 may be incorporated in tools other than junk baskets in which it is necessary to vary between direct and reverse circulation. Other modifications might include the use of different types of catcher assemblies, different types of valve means, etc. It is thus intended that the scope of the invention be limited only by the claims which follow.

I claim:

1. A junk basket comprising:

a tool body having a longitudinally extending passageway therethrough;

a magnet assembly disposed in said passageway;

retainer means cooperative between said magnet assembly and said tool body to retain said magnet assembly in a lower position in said passageway and selectively releasable to permit longitudinal movement of said magnet assembly to an upper position in said passageway; and a magnet catcher assembly carried by said tool body and engageable with said magnet assembly in said upper position to prevent downward movement of said magnet assembly from said upper position.

2. A junk basket as recited in claim 1 wherein said magnet catcher assembly includes a plurality of magnet catcher elements resiliently biased radially into said passageway, and wherein said magnet assembly includes means defining a first external generally downwardly directed shoulder engageable with said magnet catcher elements when said magnet assembly is in said upper position.

3. A junk basket as recited in claim 2 wherein said magnet assembly includes means defining a second external generally downwardly directed shoulder generally downwardly spaced from said first shoulder and engageable with said magnet catcher elements upon further upward movement of said magnet assembly from said upper position.

4. A junk basket comprising:

a tool body having a longitudinally extending passageway therethrough and a system of flowways therein for providing reverse circulation of fluid through said tool body;

a magnet assembly disposed in said passageway;

retainer means cooperative between said magnet assembly and said tool body to retain said magnet assembly in a lower position in said passageway and selectively releasable to permit longitudinal movement of said magnet assembly to an upper position in said passageway.

5. A junk basket as recited in claim 4 wherein said passageway has a portion forming a valve seat; wherein said tool further comprises a valve element selectively engageable with said seat to prevent downward flow of fluid through said passageway; and wherein said system of flowways includes a first flowway communicating with said passageway above said valve seat and extending radially outwardly through said tool body and a second flowway communicating with said passageway below said valve seat and extending radially outwardly through said tool body.

6. A junk basket as recited in claim 5 wherein said first flowway is downwardly inclined from its radially inner end to its radially outer end, and wherein said second flowway is upwardly inclined from its radially inner end to its radially outer end.

7. A junk basket as recited in claim 6 wherein said system of flowways includes a plurality of said first flowways spaced circumferentially around said tool body and a plurality of said second flowways circumferentially spaced around said tool body alternately with said first flowways.

8. A junk basket as recited in claim 5 wherein said valve element comprises a plug member insertable into said tool body through the upper end of said passageway.

9. A junk basket as recited in claim 8 wherein said plug member includes engageable means whereby said plug member may be engaged and retrieved from said tool body through the upper end of said passageway.

10. A junk basket as recited in claim 4 wherein said tool body includes core cutting means on its lower end and wherein said passageway includes a core-receiving portion adjacent the lower end of said tool body.

11. A junk basket as recited in claim 10 wherein said magnet assembly is selectively removable from said tool body.

12. A junk basket as recited in claim 10 further comprising a junk catcher assembly carried by said tool body in said core-receiving portion of said passageway.

13. A junk basket as recited in claim 4 wherein said tool body includes core cutting means on its lower end and wherein said passageway includes a core-receiving portion adjacent the lower end of said tool body.

14. A junk basket comprising:

a tool body having a longitudinally extending passageway therethrough;

a magnet assembly disposed in said passageway;

a junk catcher assembly carried by said tool body in the lower portion of said passageway and comprising a plurality of junk catcher elements resiliently biased downwardly and radially into said passageway and retractable upwardly and radially out of said passageway;

and retainer means cooperative between said magnet assembly and said tool body to retain said magnet assembly in a lower position in said passageway and selectively releasable to permit longitudinal movement of said magnet assembly to an upper position in said passageway.

15. A junk basket as recited in claim 14 comprising a plurality of said junk catcher assemblies longitudinally adjacent one another.

16. A method of removing foreign material from a well including the steps of:

a. lowering a tubular tool body having a magnet assembly therein into said well to the site of said foreign material;

b. retaining said magnet assembly in a lower position adjacent the lower end of said tool body to attract at least a portion of said foreign material;

c. releasing said magnet assembly for longitudinal movement within said tool body;

d. moving said magnet assembly upwardly within said tool body to an upper position while moving said foreign material into said tool body beneath said magnet assembly by circulating fluid downwardly along the exterior of said tool body and upwardly within said tool body adjacent the lower end of said tool body;

e. removing said tool body from said well while retaining said foreign material within said tool body.

17. The method of claim 16 comprising the further step of:

f. retaining said magnet assembly against downward movement from said upper position.

18. The method of claim 16 wherein step (b) includes circulating fluid downwardly through said tool body and about said foreign material.

19. The method of claim 16 wherein step (b) includes rotating said tool body and urging it downwardly against said foreign material.

20. The method of claim 16 wherein step (d) includes rotating said tool body and urging it downwardly against said foreign material to cut a core of said foreign material.

21. The method of claim 16 wherein step (d) is preceded by the step of:

g. closing a longitudinal passageway through said tool body at a location above the lower end of said tool body.

22. The method of claim 21 wherein step (d) is followed by the step of:

h. reopening said passageway.

23. A junk basket comprising:

a tool body having a longitudinally extending passageway therethrough;

a magnet assembly disposed in said passageway;

a junk catcher assembly carried by said tool body in the lower portion of said passageway;

and retainer means cooperative between said magnet assembly and said tool body to retain said magnet assembly in a lower position in said passageway and selectively releasable to permit longitudinal movement of said magnet assembly to an upper position in said passageway, said retainer means including releasable means interconnecting said junk catcher assembly and said magnet assembly.

24. A junk basket as recited in claim 23 including stop means cooperative between said junk catcher assembly and said tool body for limiting relative longitudinal movement between said tool body and said junk catcher assembly.

25. A junk basket as recited in claim 24 wherein said releasable means comprises shear means.

26. A junk basket as recited in claim 24 wherein said junk catcher assembly is rotatably mounted in said tool body.

27. A junk basket as recited in claim 24 wherein said junk catcher assembly in removably mounted in said tool body.

* * * * *